US005814769A

United States Patent [19]

Karlström et al.

[11] Patent Number: 5,814,769

[45] Date of Patent: Sep. 29, 1998

[54] RIBBON CABLE WITH SHIELDED CONNECTION

[76] Inventors: Anders Karlström, Erlenstrasse 1, 91341 Röttenbach; Andrea Wagner, Mindelheimer Str. 72, 90455 Nürnberg; Thomas Meschwitz, Jochensteinstr. 39, 90480 Nürnberg, all of Germany

[21] Appl. No.: 756,714

[22] Filed: Nov. 26, 1996

[30] Foreign Application Priority Data

Nov. 28, 1995 [DE] Germany ..... 195 44 357.8

[51] Int. Cl.[6] ..... H01B 7/08

[52] U.S. Cl. ..... 174/117 F; 174/78; 174/117 FF; 439/95

[58] Field of Search ..... 174/117 F, 117 FF, 174/117 A, 84 C, 78; 439/98, 99, 95, 492, 499

[56] References Cited

U.S. PATENT DOCUMENTS

| | | | |
|---|---|---|---|
| 2,779,842 | 1/1957 | Walker | 174/84 C X |
| 3,265,807 | 8/1966 | Smith | 174/84 C X |
| 3,337,834 | 8/1967 | Godwin et al. | 339/14 R |
| 3,634,782 | 1/1972 | Marshall | 174/117 F X |
| 3,653,197 | 4/1972 | Morieras et al. | 174/117 F X |
| 3,891,293 | 6/1975 | Jones | 174/84 C X |
| 3,934,075 | 1/1976 | Dilliplane | 174/117 FF X |
| 4,256,359 | 3/1981 | Storck | 174/78 X |
| 4,498,715 | 2/1985 | Peppler | 339/14 |
| 4,540,224 | 9/1985 | Maros | 339/14 R |
| 4,551,579 | 11/1985 | Takasaki | 174/84 C X |
| 4,619,487 | 10/1986 | Brush, Jr. | 339/14 R |
| 4,687,263 | 8/1987 | Cosmos et al. | 439/99 X |
| 4,864,081 | 9/1989 | Bates | 174/117 FF X |
| 5,418,330 | 5/1995 | Rook | 174/78 |

FOREIGN PATENT DOCUMENTS

| | | | |
|---|---|---|---|
| 0 187 153 | 7/1986 | European Pat. Off. . | |
| 208138 | 1/1987 | European Pat. Off. | 174/117 FF X |
| 0 532 166 | 3/1993 | European Pat. Off. . | |
| 22 59 858 | 6/1974 | Germany . | |
| 34 17 402 | 11/1984 | Germany . | |
| 38 22 980 | 1/1990 | Germany . | |
| 2114823 | 8/1983 | United Kingdom | 439/98 X |

*Primary Examiner*—Dean A. Reichard
*Attorney, Agent, or Firm*—Victor M. Genco, Jr.; Carol A. Lewis White

[57] ABSTRACT

Ribbon cable with cable conductors arranged next to each other with a cable shield and with at least one contact element provided for electrical contacting of cable shield on the outside of ribbon cable and for electrical contacting by a contact spring of a plug-in connector that accepts ribbon cable or a contact surface of an Electromagnetic Interference (EMI) housing that accepts ribbon cable. Electrical connection between the cable shield and a plug-in connector or EMI housing can be produced via the contact spring or the contact surface.

21 Claims, 7 Drawing Sheets

FIG.1
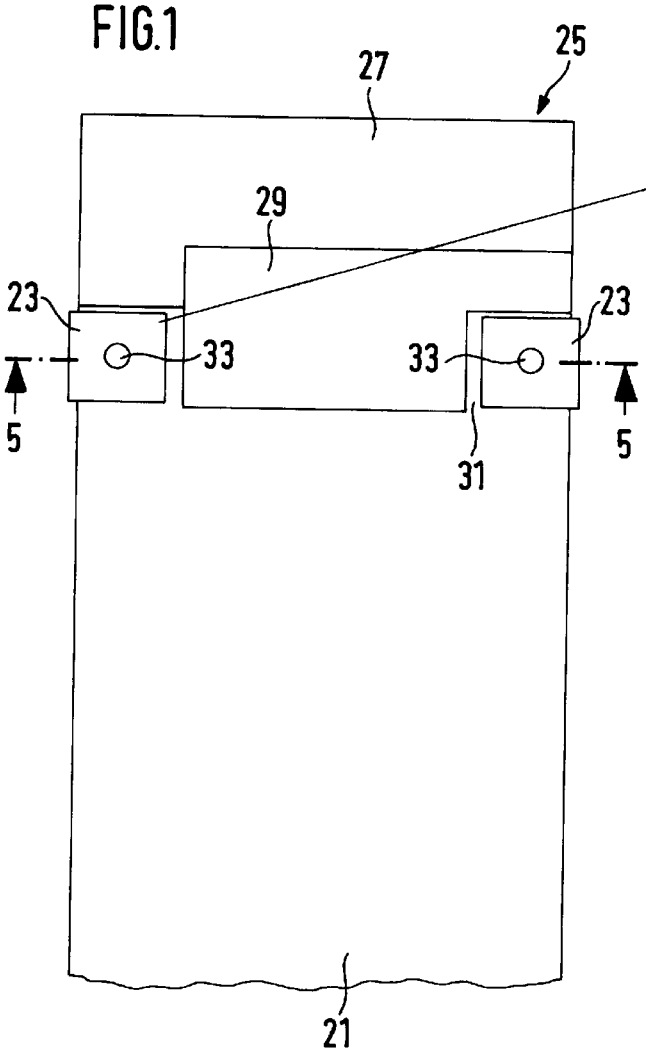
FIG. 2
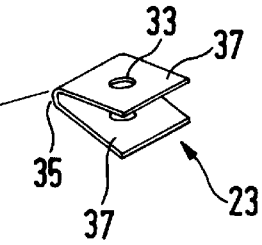
FIG. 3a
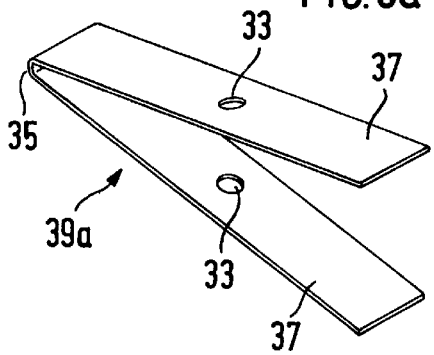
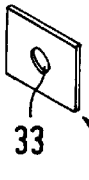
FIG. 4
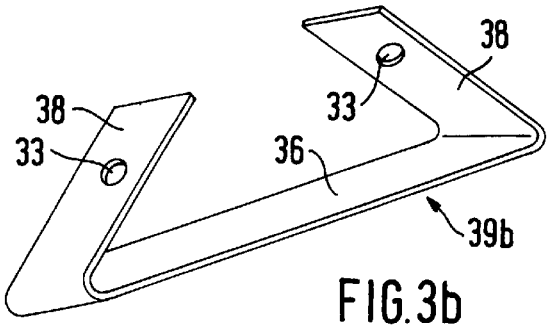
FIG. 3b

RIBBON CABLE WITH SHIELDED CONNECTION

FIELD OF THE INVENTION

The invention relates to a ribbon cable having a series of electrical cable conductors embedded next to each other in an insulation material, and an electrical cable shield on at least one flat surface of the insulation material. The invention also relates to a ribbon cable plug-in connector having a housing for plug-in connection of the ribbon cable with the plug-in connector.

BACKGROUND OF THE INVENTION

An ordinary ribbon cable 11 is shown in FIG. 19, the ribbon cable 11 possessing a series of cable conductors 13*s* and 13*m* arranged next to each other. The conductors 13*s* and 13*m* are embedded in an insulation material 15 having on one flat side (the upper side in FIG. 19) an upper shielding sheet 17 and on the other flat side a lower shielding sheet 19. The cable conductors 13*s* form signal conductors and the cable conductor 13*m* serves as a ground conductor. The insulation material 15 is removed far enough in the region of ground conductor 13*m* so that part of the ground conductor 13*m* protrudes from the insulation material 15. The two shielding sheets 17 and 19 in this region are bent onto the ground conductor 13*m* and are electrically connected to ground conductor 13*m* at their point of connection. The insulation material can be fabricated from two sheets between which the cable conductors are situated, the two sheets being glued together and to the cable conductors by means of an adhesive. The insulation material 15 can be made from polyester material. The shielding sheets 17, 19 can be fabricated from copper-coated polyester sheets.

There are disadvantages associated with the design of the above-described ribbon cable. On the one hand, electrical connection between the ground conductor 13*m* and the shielding sheets 17, 19 can exhibit relatively high contact resistance, since this connection is only produced by mechanical pressure. Moreover, the connection between shielding sheets 17, 19 and a plug-in connector housing that receives this ribbon cable 11 only occurs by means of an additional ground wire. Inclusion of this ground wire complicates the production process for the cable and for the ribbon cable plug-in connector and makes it expensive.

Automated mass production of this type of ribbon cable is demanding and expensive. The relatively high contact resistance between shielding sheets 17, 19 and ground conductor 13*m* adversely affects the quality of shield attenuation. Since the shielding sheets 17, 19 are not supported by insulation material 15 in the region connected to ground conductor 13*m*, they are mechanically quite sensitive there. The shielding sheets can be deformed in this area and hamper insertion of the ribbon cable into a plug-in connector. Use of an additional grounding wire requires space that might be available for signal conduction without the requirement of this wire.

SUMMARY OF THE INVENTION

Such problems can be overcome with a ribbon cable according to the present invention, which has at least one contact element made of an electrically conducting material that is secured on the outside of the ribbon cable with electrical contacting of the cable shield. The contact element is suitable for electrical contacting by means of a contact spring of a plug-in connector that accepts the ribbon cable or contact surface of an Electromagnetic Interference (EMI) housing that accepts the ribbon cable. EMI housing refers to a housing made of an electrically conducting material that shields against electromagnetic interference (EMI) radiation.

None of the cable conductors in the ribbon cable according to the invention need be sacrificed as ground conductor, but instead contacting of the cable shield is accomplished by means of at least one contact element secured on the outside of the ribbon cable. Mechanical weakening of the shielding sheets because of partial removal of the insulation material no longer occurs in the ribbon cable according to the invention either. In contrast, an increase in mechanical stability of the ribbon cable at the shielding contact site or shielding contact sites occurs from inclusion of the contact element or several contact elements on the outside of the ribbon cable.

A ribbon cable plug-in connector according to the invention for plug-in connection of the ribbon cable possesses a housing, on which at least one contact spring is arranged with a contacting zone for electrical contacting of at least one contact element secured on the ribbon cable. Electrical connection between the cable shield connected to the contact element and a shield potential conductor, especially ground potential conductor, of a mating connector or printed circuit board is produced via the contact springs. The contact spring can engage the longitudinal side edge of the contact element situated on the longitudinal side edge of the ribbon cable or contact a main surface of the contact element.

If a ribbon cable according to the invention is accommodated in an EMI housing, this can be assembled from two housing parts that can be assembled with inclusion of the region of the ribbon cable provided with at least one contact element between it and the EMI housing, in which at least one contacting surface can be arranged on at least one of the two housing parts that is pressed against at least one contact element in the installed EMI housing and thus comes into electrical contact with the contact element. Preferably, the at least one contact element is squeezed between opposite contact surfaces of the two EMI housing parts.

An EMI housing can be configured so that it has a receiving opening for a disk made of electrically conductive material that serves as contact element of the ribbon cable, in which the disk has a cable feed-through opening by means of which the cable is passed through the disk during electrical contact between the disk and cable shield so that an electrical connection can be made between the cable shield and the EMI housing.

However, this type of EMI housing can also be provided with one or more contact springs instead of this contact surface or disk receiving opening or in addition to it, this spring or these springs coming into contact with at least one contact element in the installed EMI housing.

On the other hand, a plug-in connector housing can also be provided with at least one disk receiving opening and/or with at least one contact surface that can be pressed against at least one contact element of the ribbon cable section inserted into the plug-in connector in the installed plug-in connector housing instead of one or more contact springs or in addition to the springs.

Since the shielding potential in these solutions is not guided via a cable conductor used as ground conductor with a comparatively small conducting cross section, but rather via at least one contact spring and/or a contact surface that can have a much greater conducting cross section than the ground conductor of the ordinary ribbon cable, particularly good shield connection occurs in the case according to the invention. The limited and safe electrical contact resistance that exists between the cable shield of the ribbon cable and, on the one hand, the at least one contact element and, on the other hand, between the at least one contact element and the at least one contact spring and/or contact surface of the connector housing or EMI housing also contributes to the good shield connection.

The contact element can be designed as a roughly U-shaped folding contact that lies against a longitudinal side edge of the ribbon cable with its U-bridge and whose U-arms are each connected to one of the two flat sides of the ribbon cable. This folding contact can be designed in the form of a contact strip extending essentially over the entire width of the ribbon cable or in the form of a contact claw extending only over a small part of the width of the ribbon cable.

The contact element can also be designed as a contact strip with a base strip whose length is essentially equal to the width of the flat side of the ribbon cable and with two arms that can be folded from each longitudinal end of the base strip and at a distance from it.

The contact element can also be a contact plate that is mounted on one flat side of the ribbon cable or a disk with a cable feed-through opening that accepts the ribbon cable.

If the cable shield forms the outside of the ribbon cable, preferably in the form of a shielding sheet, the contact element can be fastened directly to the cable shield. If an insulation sheath is situated above the cable shield, the cable shield is exposed at the fastening point for the contact element so that, despite the insulation sheath, electrical contact can be produced between the contact element and the cable shield.

If the contact element is formed from a metal strip, it can be electrically connected to the cable shield by mere pressing or by soldering. If the contact element is constructed from electrically conducting plastic, it can be brought into electrical contact with the shielding sheet by means of an electrically conductive glue.

The part of the ribbon cable provided with at least one contact element and intended for insertion into a plug-in connector housing or an EMI housing can be a ribbon cable end that is sealed with a plug-in connector or a region of the ribbon cable between the two ribbon cable ends in which a branch connection is made.

Further embodiments of the ribbon cable according to the invention and the ribbon cable plug-in connector according to the invention are described in greater detail below.

BRIEF DESCRIPTION OF THE DRAWINGS

The foregoing summary, as well as the following detailed description of a preferred embodiment of the invention, will be better understood when read in conjunction with appended drawings. In the drawings:

FIG. 1 shows a schematic top view of a ribbon cable according to the invention;

FIG. 2 shows a contact element in the form of a contact claw;

FIG. 3*a* shows a contact element in the form of a contact strip of a first variant;

FIG. 3*b* shows a contact element in the form of a contact strip of a second variant;

FIG. 4 show a contact element in the form of a contact plate;

FIG. 18 shows a narrow side view of the arrangement depicted in

FIG. 17 in a disk receiving opening of an EMI wall; and

DETAILED DESCRIPTION OF THE INVENTION

Figure 5:
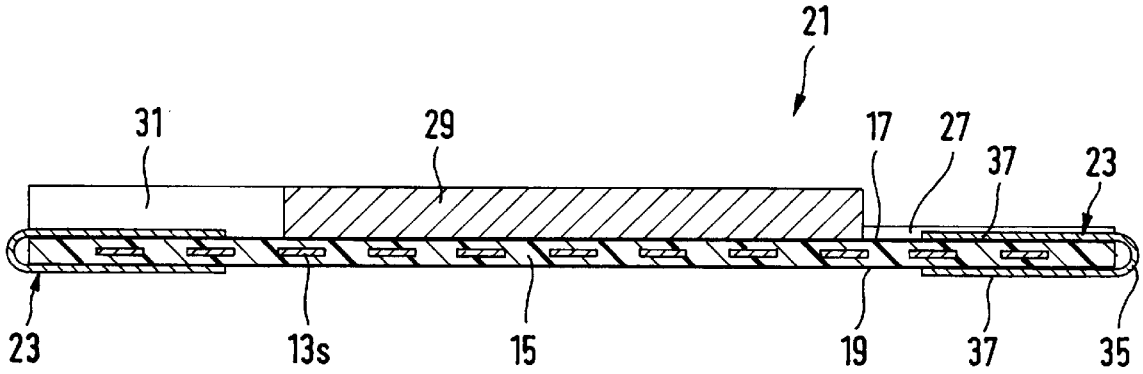
FIG. 5 shows a cross-sectional view of a ribbon cable according to the invention along line 5—5 in FIG. 1.

Referring now to the drawings, wherein similar reference characters designate corresponding parts throughout the several views, FIG. 1 shows a top view of a ribbon cable 21 equipped according to the invention with contact claws 23, one of which is shown in a perspective view in FIG. 2. Each of the contact claws 23 is formed by a folding contact in the form of a roughly U-shaped folded material strip that lies with its U-bridge 35 against a longitudinal side edge of ribbon cable 21 and whose U-arms 37 are connected to the two flat sides of ribbon cable 21. The two U-arms 37 are short in comparison with the width of the flat side of ribbon cable 21.

It is assumed in conjunction with FIG. 1 that the outsides of the two flat sides of ribbon cable 21 are each formed by a cable shield, preferably in the form of a shielding strip and that the two U-arms 37 of the two contact claws 23 are positioned on the lower 17 and upper 19 shielding sheets (FIG. 5). If the contact claws 23 consist of solid metal, they are preferably pressed onto ribbon cable 21 and additionally soldered to shielding sheets 17, 19. If the contact claws 23 consist of plastic, which is made conductive by incorporation of electrically conducting particles, the contact claws 23 can be attached to the shielding sheets 17, 19 by means of an electrically conductive glue.

In order to be able to connect the cable conductors to the conductor contacts of a plug-in connector that accepts ribbon cable end 25, the cable conductors are exposed in the region of cable end 25 on a flat side of ribbon cable 21.

Because of the mechanical weakening of the ribbon cable end 25, a reinforcement layer, preferably in the form of a stiffening sheet 27, is provided on the flat side of ribbon cable end 25 on which the cable conductors are not exposed. A locking rib 29 is set back relative to ribbon cable end 25 and extends over part of the flat side width of ribbon cable 21 and cooperates in locking fashion with a locking shoulder 59 (FIG. 7) in a plug-in connector housing 43 into which ribbon cable end 25 can be inserted. In this fashion the ribbon cable 21 is securely held in plug-in connector housing 43.

Figure 8:
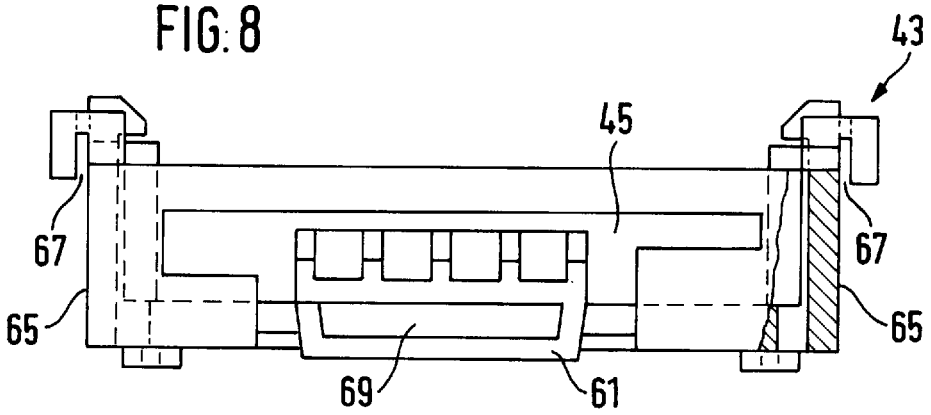
FIG. 8 shows an end view of a plug-in connector housing according to the invention on he cable insertion side.

The locking rib 29 is displaced relative to the longitudinal center line of ribbon cable 21 in order to ensure proper insertion of ribbon cable end 25 into a cable insertion opening 45 of plug-in connector housing 43 displaced in complementary fashion (FIG. 8).

Since the contact claws 23 are arranged at the level of the locking rib 29 when viewed in the longitudinal direction of ribbon cable 21, the locking rib 29 has a rib recess 31 on its right side in FIG. 1 in which the right contact claw 23 in FIG. 1 is accommodated.

In the depicted variant, the two arms 37 of each contact claw 23 are each provided with a through-hole 33, which can serve as visual control of the soldered connection between shielding sheets 17, 19 and contact claw 23 and can also form a locking device that can snap into a complementary locking element of the plug-in connector housing or EMI housing when ribbon cable 21 is inserted into a plug-in connector housing or an EMI housing. The locking element can serve as an additional contacting element for an additional ground connection between the contact claw and the plug-in connector or EMI housing.

Figure 7:
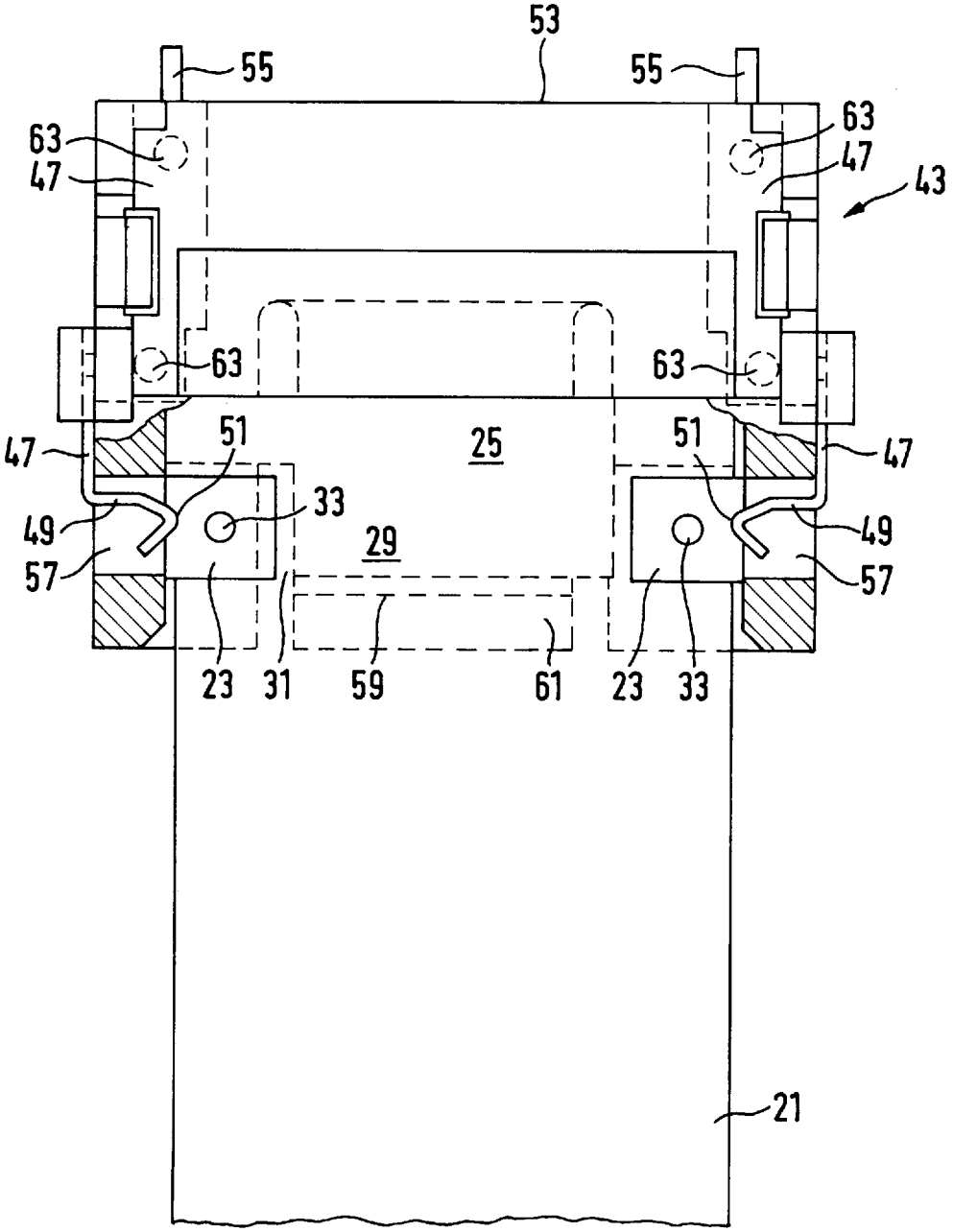
FIG. 7 shows a schematic top view, partially in cross section of a ribbon cable plug-in connector according to the invention with a ribbon cable according to the invention and a plug-in connector housing with contact springs according to the invention.

One of the contact claws 23 is shown in FIG.2 in a perspective oblique view in which the U-bridge 35 and the two U-arms 37 can be seen. FIG. 3*a* shows a contact strip 39*a* in a perspective oblique view that coincides in the length of its U-arms 37 with the contact claw 23. The U-arms 37 of contact strip 39 have a length essentially equal to the width of the flat side of ribbon cable 21. Only a single contact strip 39*a* is therefore required even if one intends to engage one contact spring 47 on each of the two longitudinal side edges of ribbon cable 21 (FIG. 7). If a locking rib 29 is arranged on the ribbon cable 21 in a case when a contact strip 39*a* is also provided, the fastening side of the contact strip 39*a* on ribbon cable 21 is displaced in the longitudinal direction of the ribbon cable relative to the fastening sites shown in FIG. 1 for the two contact claws 23. The arms 37 of the contact strip 39*a* can also each be provided with a through-hole 33.

FIG. 3*b* shows a contact strip 39*b* in a perspective oblique view that has a base strip 36 with a length corresponding to the width of the flat side of ribbon cable 21 and two arms 38, one of which can be folded from one end and the other from the other end of base strip 36 with spacing relative to base strip 36. The arms 38 of contact strip 39*b* have a length essentially equal to half the width of the flat side of ribbon cable 21. The arms 38 can also be shorter than half the width of the ribbon cable 21. Only a single contact strip 39*b* is therefore required in this contact strip 39*b* even if one intends to engage a contact spring 47 on each of the two longitudinal side edges of ribbon cable 21 (FIG. 7). If a locking rib 29 is also arranged on ribbon cable 21 when a contact strip 39*b* is provided, the fastening side of contact strip 39*b* on ribbon cable 21 is displaced in the ribbon cable longitudinal direction relative to the fastening sites for the two contact claws 23 shown in FIG. 1. The arms of the contact strip 39*b* can also each be provided with a through-hole 33.

FIG. 4 shows a contact plate 41 that can be fastened to ribbon cable 21 instead of a contact claw 23 by soldering or gluing, depending on whether the material of the contact plate 41 is metal or conducting plastic. Preferably, a contact plate 41 is fastened to each longitudinal side edge of ribbon cable 21 in similar fashion to the variant shown in FIG. 1. If one shielding sheet 17, 19 is situated on each of the two flat sides of ribbon cable 21, a contact plate 41 is preferably attached to each longitudinal side edge and on each flat side of ribbon cable 21. The contact plate 41 is also preferably provided with a through-hole 33.

FIG. 5 shows a cross-sectional view along line 5—5 in FIG. 1, but with a modification to the extent that the rib recess 31 is situated on the other longitudinal side edge of ribbon cable 21 in contrast to the variant shown in FIG. 1.

Figure 19:
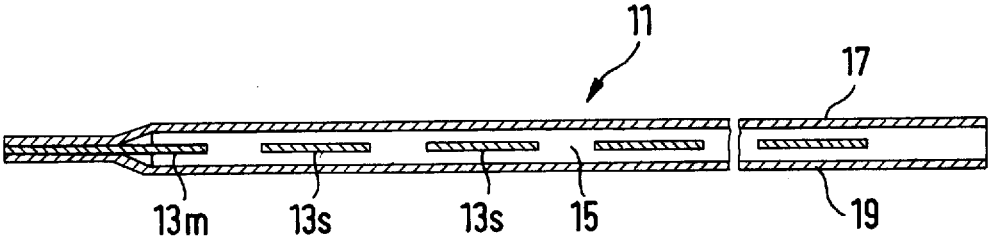
Prior Art FIG. 19
FIG. 19 shows a cross section through the already mentioned ribbon cable of known design.

The ribbon cable 21 depicted in FIG. 5, like the known ribbon cable 11 shown in FIG. 19, has a series of signal conductors 13*s* arranged next to each other, which are embedded in insulation material 15, on both flat sides of which shielding sheets 17 and 19 are situated. However, unlike the known cable design according to FIG. 19, all cable conductors are fully embedded in the insulation material and all have the function of a signal conductor 13*s*. A contact claw 23, by means of which both shielding sheets 17, 19 are electrically contacted, is attached on each longitudinal side edge of ribbon cable 21.

The stiffening sheet 27 and locking rib 29 are designed in one piece in the variant shown in FIG. 5, but could also be separate components.

Figure 6:
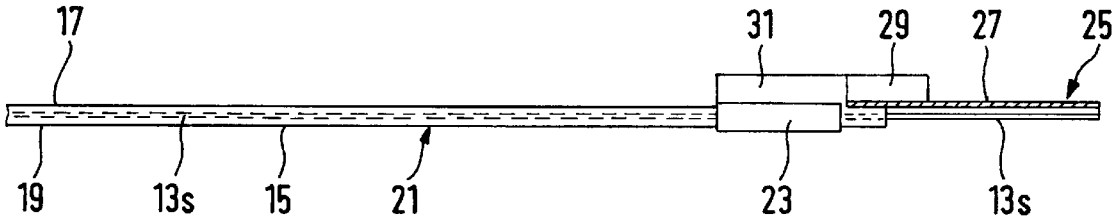
FIG. 6 shows a narrow side view of a ribbon cable according to the invention.

It is apparent in the narrow side view of ribbon cable 21 shown in FIG. 6 that the cable conductors are exposed on ribbon cable end 25 on the flat side pointing downward in FIG. 6 so that they can be brought into electrical contact with conductor contacts of a plug-in connector that accepts the ribbon cable end 25.

Figure 10:
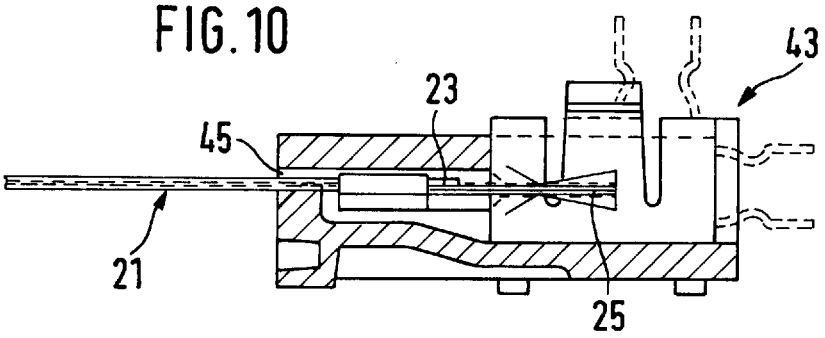
FIG. 10 shows a cross-sectional view of the plug-in connector housing depicted in FIG.9 with the inserted ribbon cable.

FIG. 7 shows a top view and partial cross section of a ribbon cable plug-in connector arrangement with a plug-in connector housing 43 and the ribbon cable 21, in which the ribbon cable end 25 is inserted into a cable insertion opening 45 (better visible in FIGS. 8 and 10). The ribbon cable 21 depicted in FIG. 7 is provided according to FIG. 1 with a contact claw 23 on each of the two longitudinal side edges. A contact spring 47 is fastened to the sides of connector housing 43 adjoining the longitudinal side edges of ribbon cable 21. These springs have a contact spring arm 49 facing the corresponding contact claw 23 on whose free end facing the corresponding contact claw 23 a convex contact zone 51 is provided. Contact tabs 55 protrude above connector housing 43 on the front side 53 facing away from cable insertion opening 45. Electrical contact to the shielded conductors of a mating connector (not shown) or a printed circuit board (also not shown) can be made by means of these contact tabs 55. The contact springs 47 are formed, secured on plug-in connector housing 43 and made of a material so that their contact zones 51 lie against the U-bridge 35 of the corresponding contact claw 23 under spring tension when the ribbon cable end 25 is inserted into the cable insertion opening 45, thereby producing electrical connection to shielding sheets 17 and 19 via contact claws 23. The contact spring arms 49 with contact zones 51 pass through the side wall openings 57 of plug-in connector housing 43.

The locking rib 29 of ribbon cable end 25 and a locking shoulder 59 that cooperates with locking rib 29 are shown with a dashed line in FIG. 7 on an elastic locking arm 61 of plug-in connector housing 43. During insertion of ribbon cable end 25 into cable insertion opening 45, the locking arm 61 widens elastically when the locking rib 29 is moved past it until the locking shoulder 59 is situated beneath locking rib 29 in FIG. 7 and can return the locking arm 61 elastically into its locking position.

The contact springs 47 are attached in the variant depicted in FIG. 7 by means of plastic buttons 63 arranged in one piece on connector housing 43. However, this fastening can also occur differently, for example, by gluing the contact spring 47 to the plug-in connector housing 43.

The cable insertion opening 45 and the locking arm 61 are readily apparent in the front view of the plug-in connector housing 43 shown in FIG. 8. In addition, mounting seats 67 for the contact spring 47 can be seen there on the side wall 65 on the plug-in connector housing 43. The locking arm 61 widens downward elastically during introduction of ribbon cable end 25 into cable insertion opening 45 (in consideration of FIG. 8). It is provided with an engagement recess 69 with whose help the locking arm 61 can be moved downward when the ribbon cable end 25 is to be withdrawn again from cable insertion opening 45.

Figure 9:
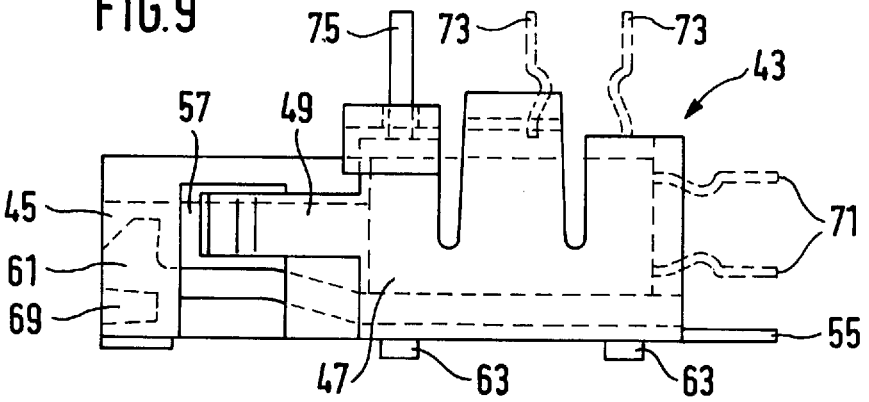
FIG. 9 shows a side view of a plug-in connector housing according to the invention provided with contact springs.

FIG. 9 shows a side view with the plug-in connector housing 43 and a contact spring 47 arranged on it. The corresponding side view with the inserted ribbon cable end 25 is shown in FIG. 10. FIGS. 9 and 10 concern variants in which the plug-in connector housing itself is not provided with conductor contacts for contacting of signal conductors 13s of ribbon cable 21. In this variant, the housing 43 forms an additional housing into which the actual plug-in connector is snapped with the conductor contacts that contact signal conductors 13*s*.

In addition to the ribbon cable plug-in connector arrangement disclosed herein, contact claws 23 (FIG. 10) and contact springs 47 (FIG. 9) are provided according to the invention. If the plug-in connector has not only a contact connection leg 71 running in the longitudinal direction of the cable, but also contact connection leg 73 running across the longitudinal direction of the cable, the contact springs 47 are preferably provided not only with contact tabs 55 extending in the longitudinal direction of the cable, but additionally with contact tabs 75 extending across the longitudinal direction of the cable.

Figure 11:
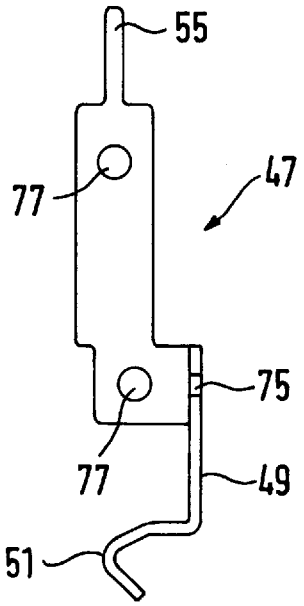
FIG. 11 shows a top view of a contact spring according to the invention.
Figure 12:
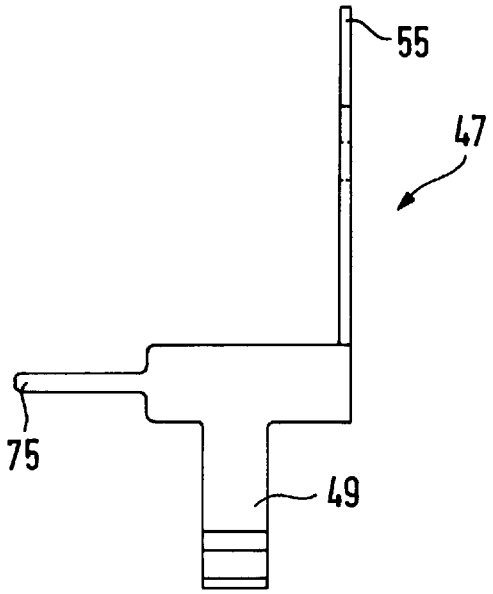
FIG. 12 shows a side view of the contact spring depicted in FIG. 11.

FIGS. 11 and 12 show a top view and a side view of a contact spring 47 used according to the invention from which the special form of the contact springs 47 shown in FIG. 7 follows even more clearly. Holes 77 serve for attachment by means of plastic buttons 63 on connector housing 43.

In the previously considered variants, the contact springs 47 contact the contact element, for example, contact claws 23 from the side, i.e., on the longitudinal side edges of the ribbon cable, in elastic fashion. However, it is also just as possible to use contact springs whose contact spring arms contact the main surfaces of the contact elements, in the case of use of contact claws 23, they are U-arms, i.e., in a direction toward the flat sides of the ribbon cable in elastic fashion.

Figure 13:
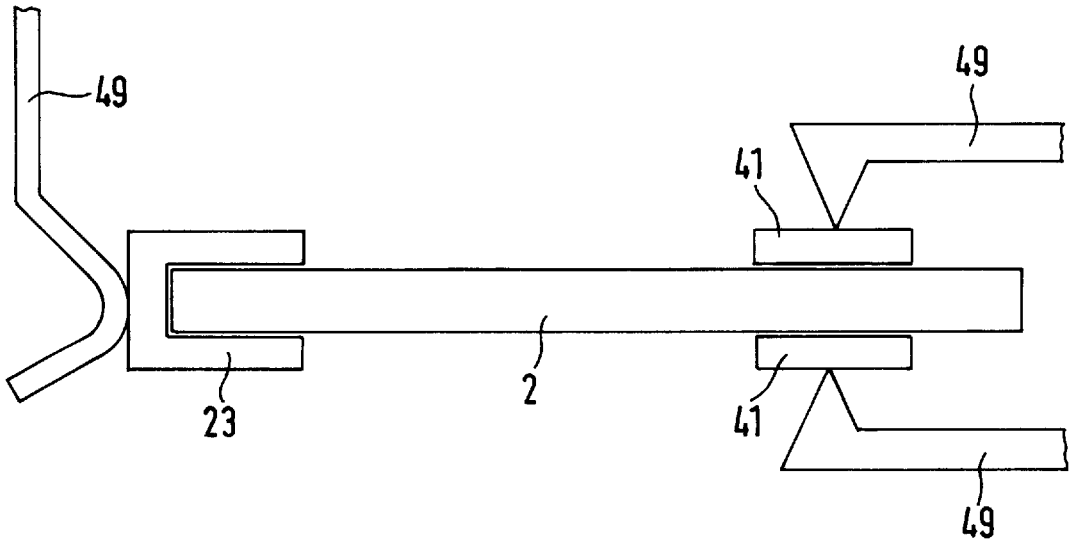
FIG. 13 schematically depicts contact springs acting in different directions.

Both possibilities are schematically shown in FIG. 13. In addition to a contact spring arm 49 that acts laterally on a contact claw 23, two contact plates 41 are shown there, which are situated on different flat sides of the ribbon cable 21 and are contacted by one contact spring arm 49 with spring tension acting toward the corresponding flat side of the ribbon cable.

The cable conductors of ribbon cable 21 can be round conductors or, as in the variant according to FIG. 5, flat conductors, which consist, for example, of copper or aluminum. For example, flat conductors are applied to a polyester sheet or laminated between polyester sheets, for example, by means of an adhesive situated between the polyester sheets, in which the polyester sheet or polyester sheets form the insulation material 15. The insulation material 15 can also be other materials, like polyvinylchloride (PVC) or polytetrafluoroethylene (PTFE). The ribbon cable 21 can be constructed with one or more cable shields 17, 19, for example, in the form of one or more copper or aluminum sheets or polyester sheets coated with copper or aluminum. One or more layers of insulating material can be applied as outer sheath of the cable above the cable shield or cable shields 17, 19. As already mentioned, the contact elements, for example, contact claws 23, can consist of metal or conducting plastic. The contact springs 47 preferably consist of a metal that possesses both good electrical conductivity and good spring properties. Copper alloys with high spring constants are used, for example.

Figure 16:
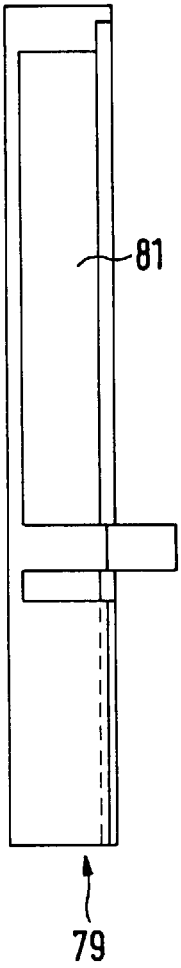
FIG. 16 shows a broad side view of the EMI housing half.
Figure 14:
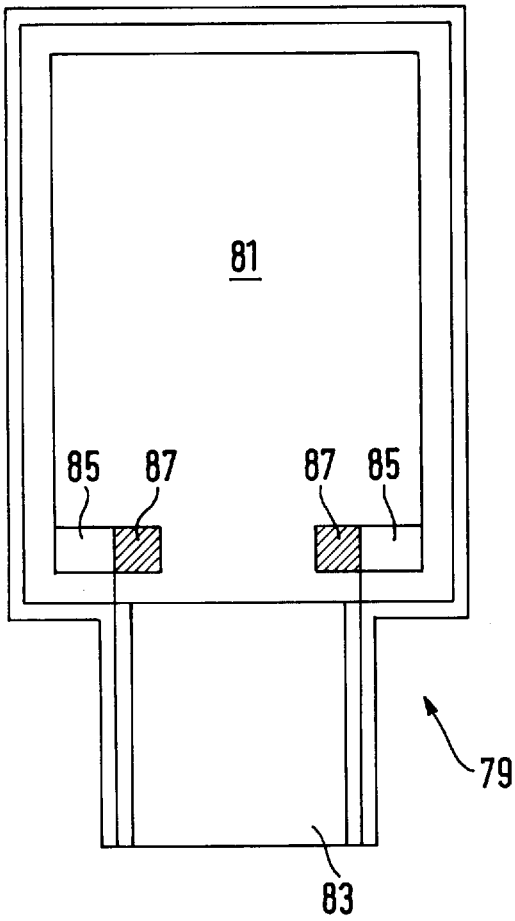
FIG. 14 shows a top view of a housing half of an EMI housing to accept to a ribbon cable according to the invention.
Figure 15:
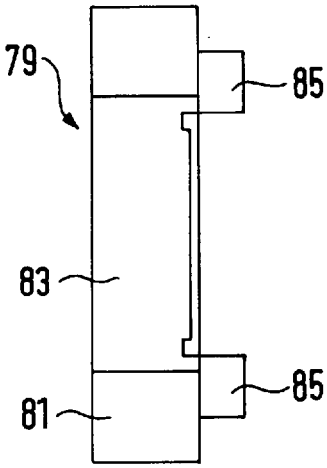
FIG. 15 shows a narrow side view of the EMI housing half.

Another example of an EMI housing in which a ribbon cable according to the invention can be arranged is considered with reference to FIGS. 14 to 16. This EMI housing is assembled from two housing halves, only one of which is shown in FIGS. 14 to 16, namely, in a top view in FIG. 14, in a narrow side view in FIG. 15 and longitudinal side view in FIG. 16.

An EMI housing half 79 shown in FIG. 14 has a mounting space for a ribbon cable end (not shown) and a device connected to it, for example, a connector connected to the ribbon cable end, an electrical or electronic device, or the like. The EMI housing half 79 on the right side in FIG. 14 is provided with a cable insertion connector opened rightward. In the vicinity between the transition between the cable insertion connector 83 and the mounting space 81, the EMI housing half 79 is provided with two positioning protrusions 85 that are taken up in complementary positioning recesses during joining of the depicted EMI housing half 79 with the corresponding other EMI housing half. In this fashion a mated joining of the two EMI housing halves is ensured. However, a positioning protrusion and positioning recess can also be arranged in complementary fashion on each of the two EMI housing halves or a number other than two positioning protrusions and two complementary positioning recesses can be provided on each EMI housing half.

In addition, at least one of the two EMI housing halves is provided with at least one contact surface 87 that is pressed against at least one contact element 23 or 39*a* or 39*b* or 41 in the joined state of the two EMI housing halves so that electrical connection occurs between the EMI housing and the cable shield and the ribbon cable situated in it. Two contact surfaces 87 are provided in the variant depicted in FIG. 14, which are situated on the inside of the positioning protrusion 85 and serve for electrical contacting of a contact claw 23 or a contact plate 41 or together cause contacting of a contact strip 39*a* or 39*b*.

Figure 17:
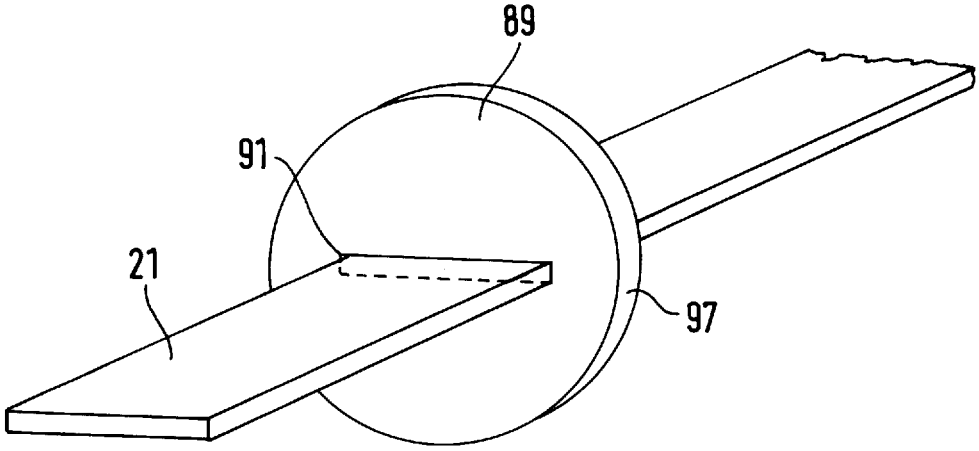
FIG. 17 shows a perspective view of a ribbon cable provided with a contact element in the form of a disk.
Figure 18:
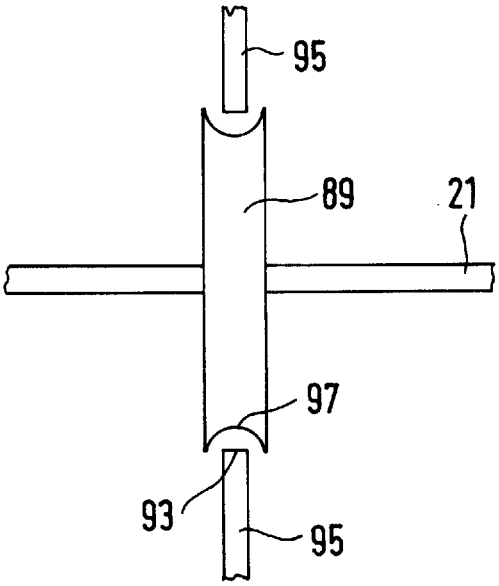

FIGS. 17 and 18 show a ribbon cable 21 in an oblique view or in a narrow side top view, which is provided with a contact element in the form of an electrically conducting disk 89 that has a cable feed-through opening 91 for this purpose with a shape adapted to the outer contour of ribbon cable 21. According to FIG. 18 the disk 89 is inserted into a disk receiving opening 93 of an electrically conducting wall 95, which can be a wall of an EMI housing, with electrical contacting of this wall 95. In this case the disk receiving opening 93 can be formed in a one-piece wall 95 or between two partial walls, for example, two housing parts. A groove 97 can be provided in the outside periphery of the disk 89 for better holding of disk 89 in disk receiving opening 93.

Having described the invention, what is claimed is:

1. Ribbon cable comprising a plurality of electrical cable conductors embedded next to each other in an insulation material, an electrical cable shield on one of two flat sides of the insulation material, and at least one contact element consisting of an electrically conducting material that is irremovably attached in electrical contact with said electrical cable shield, said at least one contact element being adapted for electrical contacting by means of a contact spring of a plug-in connector that accepts the ribbon cable and a contact surface of an electromagnetic interference (EMI) housing that accepts the ribbon cable.

2. Ribbon cable according to claim 1, the at least one contact element being formed by a folding contact in the form of a roughly U-shaped folded material strip that lies with its U-bridge on one of two longitudinal side edges of the ribbon cable and whose U-arms are each connected to one of the two flat sides of the insulation material of the ribbon cable.

3. Ribbon cable according to claim 2, the folding contact being designed as a contact claw, both of whose U-arms are short in comparison with a width of the flat sides of the insulation material of the ribbon cable.

4. Ribbon cable according to claim 3, wherein the at least one contact element comprises at least two contact elements at least one of which is arranged on each of the two longitudinal side edges of the ribbon cable.

5. Ribbon cable according to claim 2, the folding contact being designed as a contact strip each of whose U-arms have a length essentially equal to a width of the flat sides of the ribbon cable.

6. Ribbon cable according to claim 1, the at least one contact element being designed as a contact strip with a base strip whose length is essentially equal to a width of the two flat sides of the insulation material of the ribbon cable and with two arms that can each be folded with spacing from one of two longitudinal ends of the base strip.

7. Ribbon cable according to claim 1, the at least one contact element being designed as a contact plate that can be arranged at any site on an outer surface of the ribbon cable.

8. Ribbon cable according to claim 7, wherein said at least one contact element comprises at least two contact elements, at least one of which is arranged on each of two longitudinal side edges of the ribbon cable.

9. Ribbon cable according to claim 1, the at least one contact element being formed from a disk having an inner region with a cable feed-through opening formed therein, the opening corresponding to an outside diameter of the ribbon cable, and an outside periphery which is adapted to be accepted in a disk receiving opening of an electrically conducting wall.

10.Ribbon cable according to claim 1 further comprising another cable shield arranged on the other of the flat sides of the insulation material of the ribbon cable.

11. Ribbon cable according to claim 10, wherein said at least one contact element comprises at least two contact elements, at least one of which is arranged on each of two longitudinal side edges of the ribbon cable.

12. Ribbon cable according to claim 1, the at least one contact element being constructed with an electrically conducting metal.

13. Ribbon cable according to claim 1, a soldered connection being formed between the at least one contact element and the cable shield.

14. Ribbon cable according to claim 13, the at least one contact element being provided with a hole that serves for visual control of a soldering site, said hole cooperating as a snap-in opening with a complementary snap-in element of a connector housing in which electrical contacting of the contact element is enabled via a locking element.

15. Ribbon cable according to claim 1, the at least one contact element being made of electrically conducting plastic and glued to the cable shield by means of an electrically conductive glue.

16. Ribbon cable according to claim 1, the cable shield forming an outer surface of the ribbon cable.

17. Ribbon cable according to claim 1 further comprising an insulation sheath situated above the cable shield, said sheath having a sheath opening that exposes the cable shield at an attachment site of the at least one contact element.

18. Ribbon cable according to claim 1, the cable shield being formed from a shielding sheet of electrically conductive material spanning said one of the two flat sides of the insulation material of the ribbon cable.

19. Ribbon cable according to claim 1, the at least one contact element being arranged adjacent to a cable end of the ribbon cable that can be inserted into a plug-in connector housing.

20. Ribbon cable according to claim 1, the cable conductors being exposed in a region of a cable end on one of said flat sides of the insulation material of the ribbon cable and a stiffening layer being arranged on the other of said flat sides of the insulation material of the ribbon cable.

21. Ribbon cable according to claim 1 further comprising at least one locking rib running across a transverse direction of the ribbon cable and arranged on one of the two flat sides of the insulation material of the ribbon cable in a region of a fastening site of the at least one contact element for locking engagement with a complementary locking element of a connector housing that accepts the ribbon cable.

* * * * *